US009549654B1

(12) United States Patent
Williams et al.

(10) Patent No.: US 9,549,654 B1
(45) Date of Patent: Jan. 24, 2017

(54) FLUID APPLICATOR

(75) Inventors: Craig A. Williams, Maamee, OH (US); Charles J. Barnhart, Toledo, OH (US); Kirk Toczynski, Toledo, OH (US)

(73) Assignee: Designetics, Inc., Holland, OH (US)

( * ) Notice: Subject to any disclaimer, the term of this patent is extended or adjusted under 35 U.S.C. 154(b) by 2437 days.

(21) Appl. No.: 12/258,411

(22) Filed: Oct. 26, 2008

Related U.S. Application Data

(60) Provisional application No. 60/982,816, filed on Oct. 26, 2007.

(51) Int. Cl.
*A46B 11/00* (2006.01)
*A47L 13/16* (2006.01)
*B05C 1/00* (2006.01)

(52) U.S. Cl.
CPC ..... *A47L 13/16* (2013.01); *A46B 11/00* (2013.01); *B05C 1/00* (2013.01); *A46B 2200/20* (2013.01)

(58) Field of Classification Search
CPC ..... A46B 11/00; A46B 2200/20; A47L 13/16; B05C 1/00
USPC ..... 15/104.94, 209.1, 210.1, 244.1; D32/40, D32/43, 52; 401/193; D30/158
See application file for complete search history.

(56) References Cited

U.S. PATENT DOCUMENTS 1,689,855 A * 10/1928 Breitenbach ..... 15/166
D78,597 S * 5/1929 Sierad ..... D32/40
D78,752 S * 6/1929 Hill ..... D4/125
D216,276 S * 12/1969 Smith ..... D32/40
3,763,823 A 10/1973 Nilsson
4,323,193 A 4/1982 Compton et al.
4,516,697 A 5/1985 Dreps et al.
4,530,473 A 7/1985 Parry
4,600,601 A 7/1986 Tamura
D285,131 S * 8/1986 Wilkeson ..... D30/158
4,753,819 A 6/1988 Shimada
4,824,875 A 4/1989 Gutek
4,852,203 A * 8/1989 LaBelle ..... 15/210.1
4,880,663 A 11/1989 Shimada
D324,171 S 2/1992 Morane
5,131,349 A 7/1992 Keller et al.
5,188,864 A 2/1993 Lee et al.
D333,922 S * 3/1993 Strickler et al. ..... D4/136
5,277,927 A 1/1994 Burns et al.
5,323,931 A 6/1994 Robards et al.
5,331,711 A * 7/1994 Kelly ..... 15/210.1
5,370,905 A 12/1994 Varga et al.
5,510,138 A 4/1996 Sanftleben et al.
5,540,946 A 7/1996 DeVries et al.
5,704,520 A 1/1998 Gross
5,743,959 A 4/1998 Ash et al.
5,855,673 A 1/1999 Dehn
5,871,297 A 2/1999 Rogers et al.
6,045,279 A 4/2000 Follis
6,089,412 A 7/2000 Snell et al.
6,095,705 A 8/2000 Phillips
(Continued)

FOREIGN PATENT DOCUMENTS

EP A0640548 A1 3/1995

*Primary Examiner* — Randall Chin
(74) *Attorney, Agent, or Firm* — Donald K. Wedding

(57) ABSTRACT

A notched fluid applicator comprising a base with a dispenser pad or a brush. The notch allows the application of a fluid to a surface containing one or more protrusions. The applicator may be used to apply fluid to the surface of an article such as a glass substrate, printed circuit board, or other surface containing one or more protrusions.

15 Claims, 11 Drawing Sheets

(56) References Cited

U.S. PATENT DOCUMENTS

| | | | | | |
|---|---|---|---|---|---|
| 6,228,168 | B1 | | 5/2001 | Johnson | |
| 6,386,401 | B1 | | 5/2002 | Dodd et al. | |
| 6,394,681 | B1 | | 5/2002 | Moore | |
| 6,471,774 | B1 | | 10/2002 | Krueger | |
| D468,633 | S | | 1/2003 | DeWood | |
| 6,547,880 | B1 | | 4/2003 | Krueger et al. | |
| D480,632 | S | | 10/2003 | Williams et al. | |
| D480,852 | S | * | 10/2003 | Farce | D32/40 |
| D480,959 | S | | 10/2003 | Dewood | |
| 6,641,665 | B2 | | 11/2003 | Krueger | |
| 6,649,220 | B1 | | 11/2003 | Krueger et al. | |
| 6,695,917 | B2 | | 2/2004 | Wright et al. | |
| 6,805,682 | B1 | | 10/2004 | Campbell | |
| D514,761 | S | * | 2/2006 | Seregni et al. | D32/40 |
| 7,013,834 | B2 | | 3/2006 | Tyler et al. | |
| D521,246 | S | * | 5/2006 | Huller | D4/124 |
| 7,124,465 | B1 | * | 10/2006 | Kaminstein | 15/244.3 |
| D532,979 | S | * | 12/2006 | Viola | D4/129 |
| D552,812 | S | * | 10/2007 | Dotterman et al. | D32/40 |
| 2002/0130141 | A1 | | 9/2002 | Gardos | |
| 2003/0000461 | A1 | | 1/2003 | Krueger | |
| 2003/0156886 | A1 | | 8/2003 | Akaishi | |
| 2004/0047995 | A1 | | 3/2004 | Krueger | |
| 2005/0084316 | A1 | | 4/2005 | Lani Bradley et al. | |
| 2005/0100389 | A1 | | 5/2005 | Tsaur | |
| 2005/0226677 | A1 | | 10/2005 | Zwaert et al. | |
| 2005/0236430 | A1 | | 10/2005 | Clark et al. | |

* cited by examiner

FLUID APPLICATOR

RELATED APPLICATION

This application claims priority under 35 U.S.C. 119(e) of U.S. Provisional Application Ser. No. 60/982,816, filed Oct. 26, 2007.

FIELD OF INVENTION

This invention relates to a notched fluid applicator for applying a fluid to an object during the movement of the object or the fluid applicator relative to the other. The fluid applicator may also be called a fluid applicator tip or tip. This invention is particularly directed to a notched fluid applicator that uniformly deposits a layer of fluid on a surface containing one or more protrusions.

BACKGROUND OF INVENTION

In the prior art, materials are applied to an object such as the surface of a substrate by a variety of means that include dispensing, depositing, coating, labeling, spraying, wetting, brushing, dripping, flow coating, immersion, screen printing, and so forth.

One of the primary uses of fluid applicators is in the automotive industry where a fluid applicator is used to apply fluids to the edge or edges of a glass substrate such as windshields, moldings, channels, and sunroofs. In the automotive industry a coating of material is deposited on the periphery or marginal edge of a glass or plastic substrate in preparation for the application of an adhesive or sealant bonding the substrate to the vehicle. For vehicle windows, any discontinuities in the deposited coating may affect the ability of the coating to act as a moisture barrier and may affect the strength of the bonding of the window to the vehicle. Thus it is important to uniformly apply the fluid and prevent any discontinuities. The present invention is directed to a notched fluid applicator that uniformly applies a relatively thin layer of fluid with little or no discontinuity to the surface of an object such as a substrate that contains at least one protrusion.

RELATED PRIOR ART

The following references disclose a fluid applicator tip or fluid applicator, all of which are incorporated herein by reference: U.S. Pat. No. 5,131,349 (Keller et al.); U.S. Pat. No. 5,743,959 (Ash et al.); U.S. Pat. No. 6,547,880 (Krueger et al.); U.S. Design Pat. No. 480,959 (DeWood); 480,632 (Williams et al.); 468,633 (DeWood).

The following references disclose apparatus and methods for utilizing a fluid applicator in the automotive industry and are incorporated herein by reference: U.S. Pat. No. 6,649,220 (Krueger, et al.); U.S. Pat. No. 6,641,665 (Krueger); U.S. Pat. No. 6,471,774 (Krueger); U.S. Pat. No. 6,228,168 (Johnson); U.S. Pat. No. 5,540,946 (DeVries et al.); U.S. Pat. No. 5,370,905 (Varga et al.); U.S. Pat. No. 5,277,927 (Burns et al.); U.S. Patent Application Nos. 2004/0047995 (Krueger), and 2003/0000461 (Krueger).

THE INVENTION

In accordance with this invention, a fluid is selectively applied with a notched fluid applicator to a surface having one or more protrusions. The fluid includes liquid and/or gases that may contain solids such as particulates.

In the practice of this invention, a notched fluid applicator moves over a surface with one or more protrusions and applies fluid to the surface up to and beyond each protrusion in the direction that the applicator is moving. The applicator is lifted manually (by hand) or automatically (robotically) over each protrusion and then reset on the surface past the protrusion to continue along the substrate surface, applying fluid to the next protrusion or to the edge of the substrate. The surface and may be made of glass, ceramic, glass ceramic, stone, plastic, metal, rubber, wood or any other suitable material. Composites or layers of different materials may be used, i.e. glass and ceramic, glass and plastic, glass and metal, plastic and metal, etc. The substrate surface may be flat, irregular, or contoured. The surface may have been previously treated with one or more fluids.

This invention is particularly suitable for applying fluid to a substrate surface that has a multiplicity of protrusions. The protrusions may be of any suitable geometric shape, and include pins, bolts, screws, clips, bumps, fasteners, nails, and so forth. The protrusions may extend from the surface at any angle, typically about 5 degrees to about 90 degrees relative to the substrate surface.

The fluid applicator of this invention comprises a notched hollow base and a dispenser pad such as a porous material that applies the fluid to the surface. The base may include other structures such as a shoulder located inside or outside the hollow base. The dispenser pad is retained within the hollow base. Examples of fluid applicators contemplated in the practice of this invention are disclosed in the related prior art cited above and are incorporated herein by reference.

BRIEF DESCRIPTION OF THE DRAWINGS

FIG. 3AA is a top environmental view of the notched fluid applicator at position $p_0$.

FIG. 3BB is a right side environmental view of the notched fluid applicator at position $p_0$.

FIG. 3CC is a top environmental view of the notched fluid applicator at position $p_1$.

FIG. 3DD is a right side environmental view of the notched fluid applicator at position $p_1$.

DETAILED DESCRIPTION OF THE DRAWINGS

Figure 1:
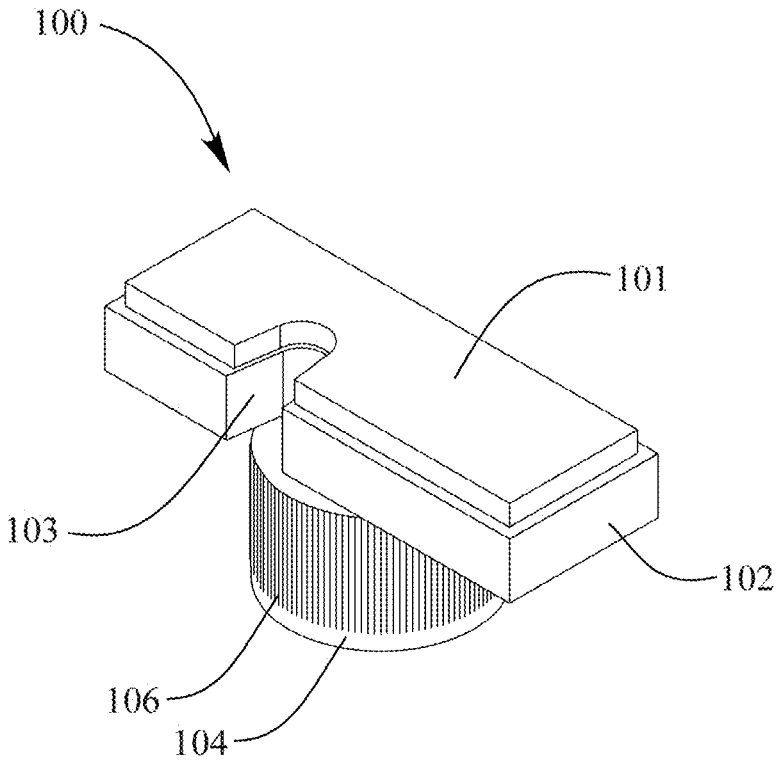
FIG. 1 is an isometric view of the notched fluid applicator.

FIG. 1 is an isometric view of a notched fluid applicator assembly 100. Shown are dispenser pad 101, base 102, notch 103, cap 104, and knurling 106, which is optional. The optional knurling 106 is useful for gripping or holding the cap 104. The cap 104 is threaded in order to screw onto a dispensing tube (not shown). The dispensing tube may be used by a robot, or by hand or any other means. The dispensing tube (not shown) may be a portion of a robot (not shown), a bottle (not shown), or hose (not shown).

Figure 1A:
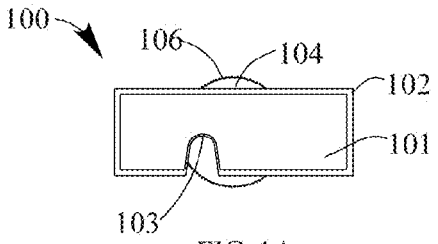
FIG. 1A is a top view of the notched fluid applicator shown in FIG. 1.

FIG. 1A is a top view of the notched fluid applicator assembly 100. Shown are dispenser pad 101, base 102, notch 103, cap 104, and optional knurling 106.

Figure 1C:
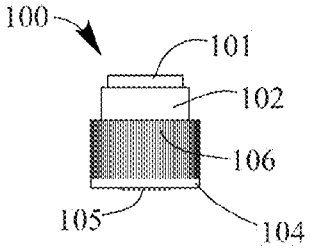
FIG. 1C is a left or right side elevation of the notched fluid applicator shown in FIG. 1.
Figure 1B:
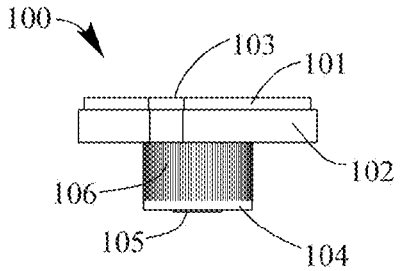
FIG. 1B is a front elevation of the notched fluid applicator shown in FIG. 1.

FIG. 1B is a front elevation of the notched fluid applicator assembly 100. Shown are dispenser pad 101, base 102, notch 103, cap 104, orifice 105, and optional knurling 106. The fluid is introduced into the applicator assembly through the orifice 105 from a reservoir source. The orifice 105 may not be used where the applicator is mounted to a robot.

FIG. 1C is a left or right side elevation of the notched fluid applicator assembly 100. Shown are dispenser pad 101, base 102, cap 104, orifice 105, and optional knurling 106.

Figure 1D:
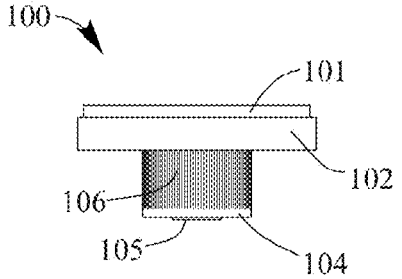
FIG. 1D is a back elevation of the notched fluid applicator shown in FIG. 1.

FIG. 1D is a back elevation of the notched fluid applicator assembly 100. Shown are dispenser pad 101, base 102, notch 103, cap 104, orifice 105, and optional knurling 106.

Figure 1E:
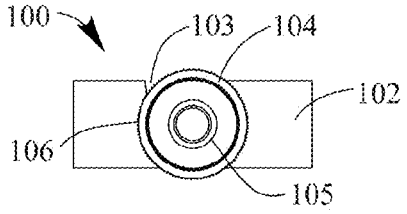
FIG. 1E is a bottom view of the notched fluid applicator shown in FIG. 1.

FIG. 1E is a bottom view of the notched fluid applicator shown assembly 100. Shown are base 102, notch 103, cap 104, orifice 105, and optional knurling 106.

Figure 1F:
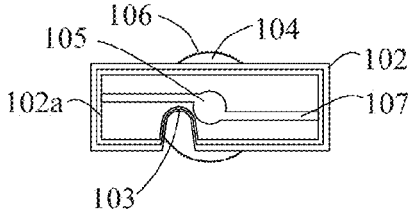
FIG. 1F is a top view of the notched fluid applicator without the porous material or dispenser pad shown in FIG. 1A.

FIG. 1F is a top view of the notched fluid applicator without the dispenser pad. Shown are base 102, base track 102*a*, notch 103, cap 104, orifice 105, optional knurling 106, and flow control track 107. The flow control track 107 distributes the fluid introduced via the orifice 105 over the dispenser pad 101 when it is in place. The base track 102*a* serves as a resting place for the dispenser pad 101 (not shown), so as to prevent the dispenser pad 101 from coming in contact with the orifice 105.

Figure 2:
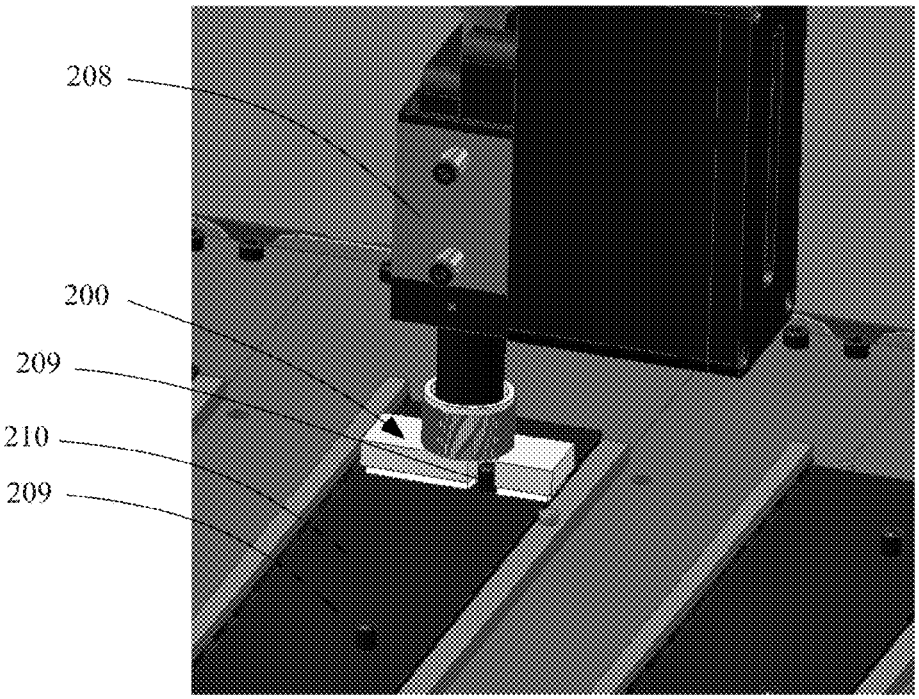
FIG. 2 is an environmental view of the notched fluid applicator of FIG. 1.

FIG. 2 is an environmental view of the notched fluid applicator 200 mounted onto a robotic arm 208 applying a fluid (not shown) to a substrate 210 with multiple protrusions 209.

Figure 3A:
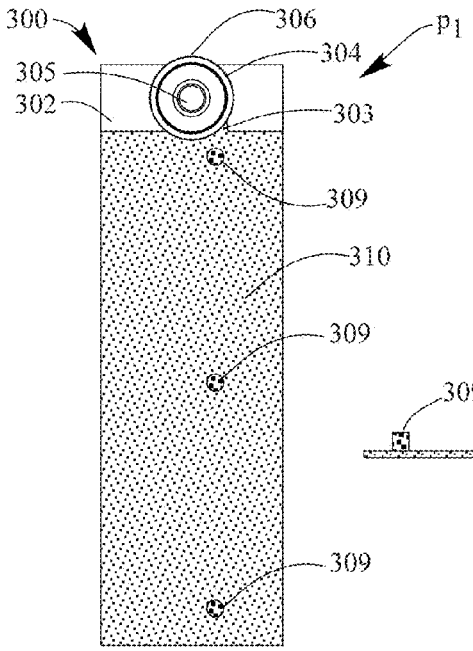
FIG. 3A is a top environmental view of the notched fluid applicator at position $p_1$.

FIG. 3A is a top environmental view of the notched fluid applicator 300 at position $p_1$, to start the process of applying a fluid (not shown) to a substrate 310 with protrusions 309. Shown are optional knurling 306, cap 304, notch 303, orifice 305, base 302, protrusion 309, and substrate 310.

Figure 3B:
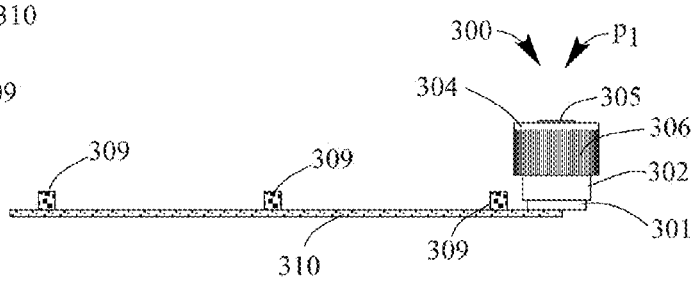
FIG. 3B is a right side environmental view of the notched fluid applicator at position $p_1$.

FIG. 3B is a right side environmental view of the notched fluid applicator 300 at position $p_1$. Shown are orifice 305, optional knurling 306, cap 304, dispenser pad 301, base 302, protrusion 309, and substrate 310.

Figure 3C:
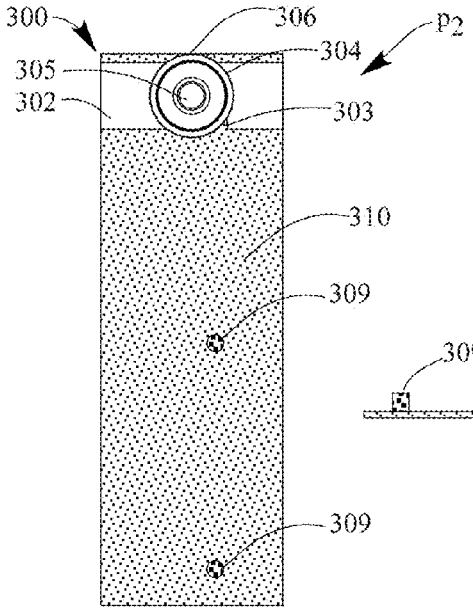
FIG. 3C is a top environmental view of the notched fluid applicator at position $p_2$.

FIG. 3C is a top environmental view of the notched fluid applicator 300 at position $p_2$. Shown are optional knurling 306, cap 304, notch 303, orifice 305, base 302, protrusion 309, and substrate 310. The notched fluid applicator 300 has been moved horizontally to position $p_2$, so that the notch 303 surrounds the protrusion 309. The notch 303 allows the dispenser pad 301 to lay a uniform layer of fluid around the protrusion 309 without using a circular motion around the protrusion 309.

Figure 3D:
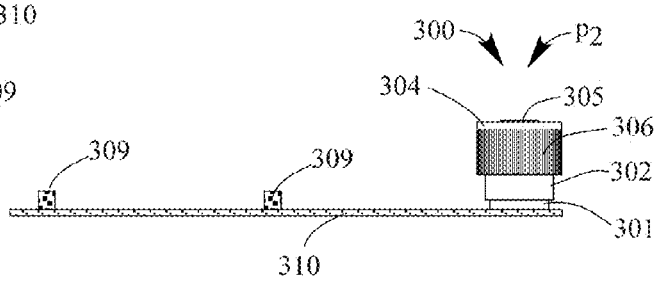
FIG. 3D is a right side environmental view of the notched fluid applicator at position $p_2$.

FIG. 3D is a right side environmental view of the notched fluid applicator 300 at position $p_2$. Shown are orifice 305, optional knurling 306, cap 304, dispenser pad 301, base 302, protrusion 309, and substrate 310.

Figure 3E:
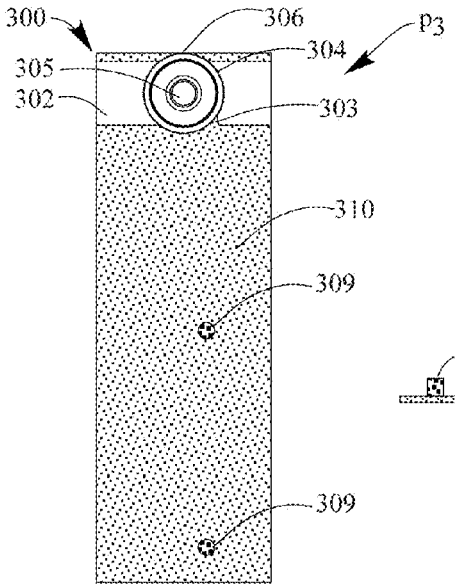
FIG. 3E is a top environmental view of the notched fluid applicator at position $p_3$.

FIG. 3E is a top environmental view of the notched fluid applicator 300 at position $p_3$. Shown are optional knurling 306, cap 304, notch 303, orifice 305, base 302, protrusion 309, and substrate 310. The notched fluid applicator 300 is moved vertically upward to position $p_3$, so as to 'jump' over the protrusion 309.

Figure 3F:
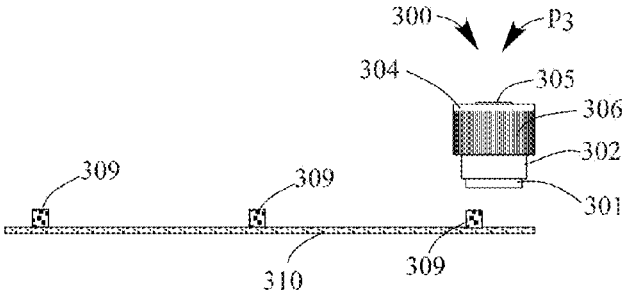
FIG. 3F is a right side environmental view of the notched fluid applicator at position $p_3$.

FIG. 3F is a right side environmental view of the notched fluid applicator 300 at position $p_3$. Shown are orifice 305, optional knurling 306, cap 304, dispenser pad 301, base 302, protrusion 309, and substrate 310.

Figure 3G:
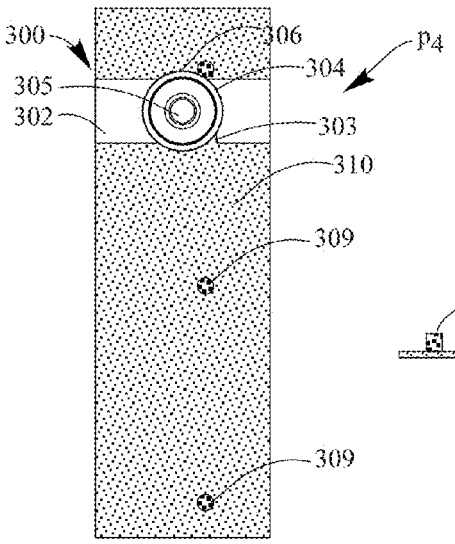
FIG. 3G is a top environmental view of the notched fluid applicator at position $p_4$.

FIG. 3G is a top environmental view of the notched fluid applicator 300 at position $p_4$. Shown are optional knurling 306, cap 304, notch 303, orifice 305, base 302, protrusion 309, and substrate 310. Notched fluid applicator 300 is moved horizontally to position $p_4$, continuing the 'jump' over the protrusion 309.

Figure 3H:
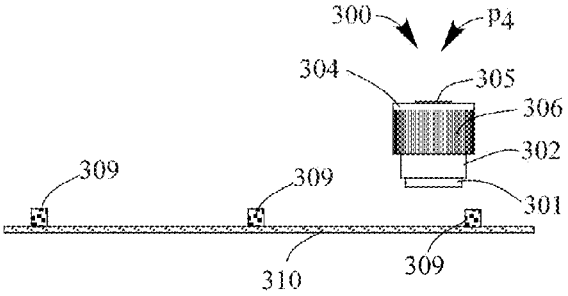
FIG. 3H is a right side environmental view of the notched fluid applicator at position $p_4$.

FIG. 3H is a right side environmental view of the notched fluid applicator 300 at position $p_4$. Shown are orifice 305, optional knurling 306, cap 304, dispenser pad 301, base 302, protrusion 309, and substrate 310.

Figure 3I:
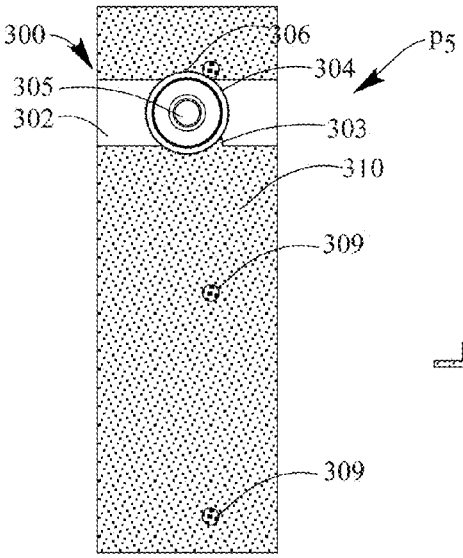
FIG. 3I is a top environmental view of the notched fluid applicator at position $p_5$.

FIG. 3I is a top environmental view of the notched fluid applicator 300 at position $p_5$. Shown are optional knurling 306, cap 304, notch 303, orifice 305, base 302, protrusion 309, and substrate 310. The notched fluid applicator 300 is moved vertically downward until it contacts the substrate 310 at position $p_5$, completing the 'jump' over the protrusion 309.

Figure 3J:
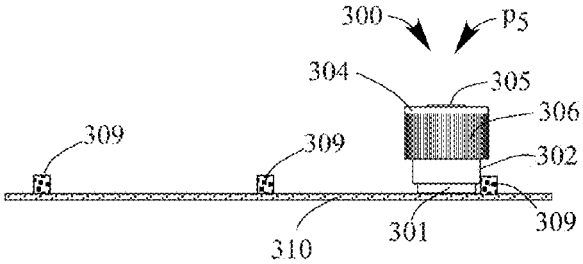
FIG. 3J is a right side environmental view of the notched fluid applicator at position $p_5$.

FIG. 3J is a right side environmental view of the notched fluid applicator 300 at position $p_5$. Shown are orifice 305, optional knurling 306, cap 304, dispenser pad 301, base 302, protrusion 309, and substrate 310.

Figure 3K:
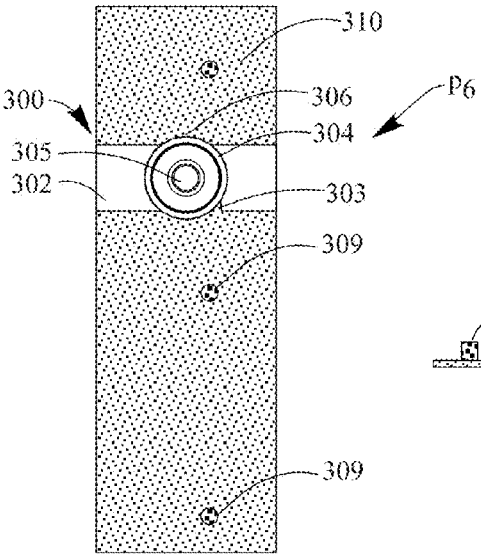
FIG. 3K is a top environmental view of the notched fluid applicator at position $p_6$.

FIG. 3K is a top environmental view of the notched fluid applicator 300 at position $p_6$. Shown are optional knurling 306, cap 304, notch 303, orifice 305, base 302, protrusion 309, and substrate 310. The notched fluid applicator 300 is moved horizontally along the substrate 310 through position $p_6$.

Figure 3L:
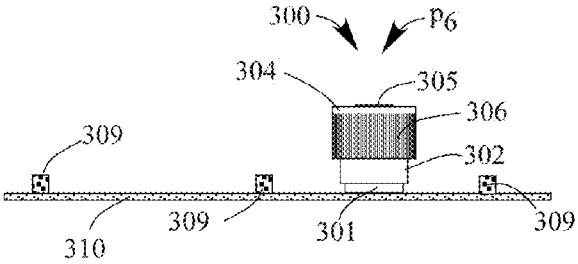
FIG. 3L is a right side environmental view of the notched fluid applicator at position $p_6$.

FIG. 3L is a right side environmental view of the notched fluid applicator 300 at position $p_6$. Shown are orifice 305, optional knurling 306, cap 304, dispenser pad 301, base 302, protrusion 309, and substrate 310.

Figure 3M:
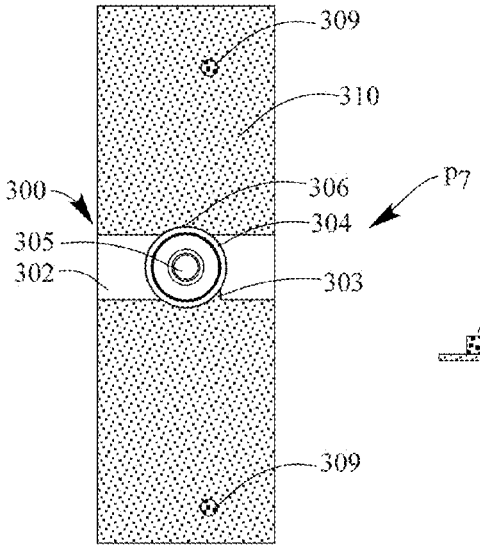
FIG. 3M is a top environmental view of the notched fluid applicator at position $p_7$.

FIG. 3M is a top environmental view of the notched fluid applicator 300 at position $p_7$. Shown are optional knurling 306, cap 304, notch 303, orifice 305, base 302, protrusion 309, and substrate 310. The notched fluid applicator 300 has moved horizontally to position $p_7$, so that the notch 303 surrounds the protrusion 309. The notch 303 allows the dispenser pad 301 to lay a uniform layer of fluid around the protrusion 309 without using a circular motion around the protrusion 309.

Figure 3N:
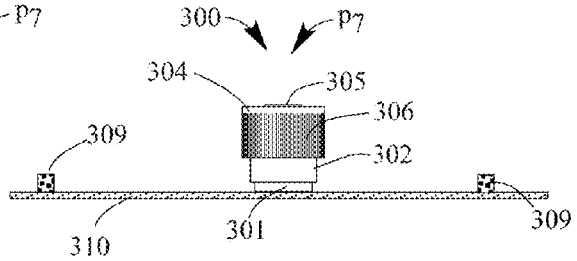
FIG. 3N is a right side environmental view of the notched fluid applicator at position $p_7$.

FIG. 3N is a right side environmental view of the notched fluid applicator 300 at position $p_7$. Shown are orifice 305, optional knurling 306, cap 304, dispenser pad 301, base 302, protrusion 309, and substrate 310.

Figure 3O:
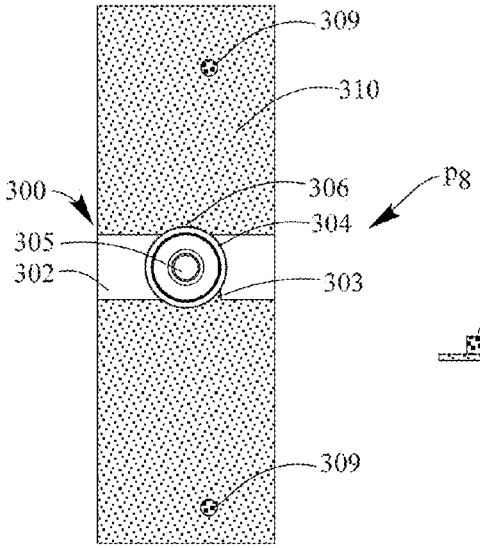
FIG. 3O is a top environmental view of the notched fluid applicator at position $p_8$.

FIG. 3O is a top environmental view of the notched fluid applicator 300 at position $p_8$. Shown are optional knurling 306, cap 304, notch 303, orifice 305, base 302, protrusion 309, and substrate 310. Notched fluid applicator 300 is moved vertically upward to position $p_8$, so as to 'jump' over the protrusion 309.

Figure 3P:
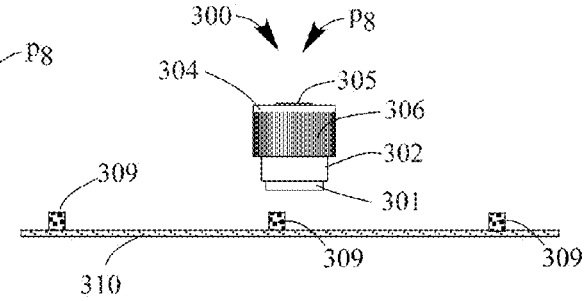
FIG. 3P is a right side environmental view of the notched fluid applicator at position $p_8$.

FIG. 3P is a right side environmental view of the notched fluid applicator 300 at position $p_8$. Shown are orifice 305, optional knurling 306, cap 304, dispenser pad 301, base 302, protrusion 309, and substrate 310.

Figure 3Q:
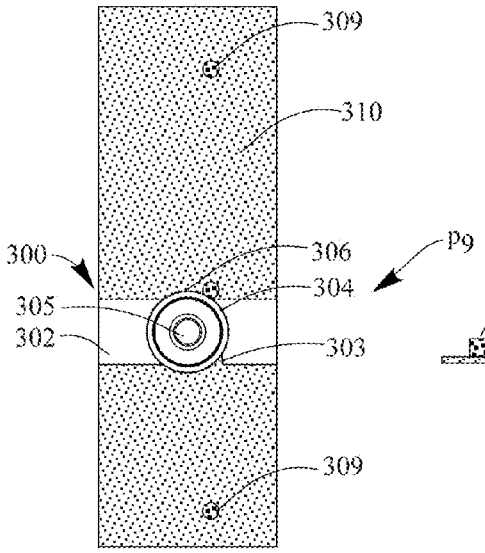
FIG. 3Q is a top environmental view of the notched fluid applicator at position $p_9$.

FIG. 3Q is a top environmental view of the notched fluid applicator 300 at position $p_9$. Shown are optional knurling 306, cap 304, notch 303, orifice 305, base 302, protrusion 309, and substrate 310. Notched fluid applicator 300 is moved horizontally to position $p_9$, continuing the 'jump' over the protrusion 309.

Figure 3R:
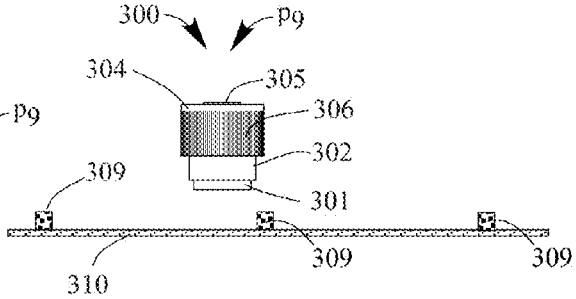
FIG. 3R is a right side environmental view of the notched fluid applicator at position $p_9$.

FIG. 3R is a right side environmental view of the notched fluid applicator 300 at position $p_9$. Shown are orifice 305, optional knurling 306, cap 304, dispenser pad 301, base 302, protrusion 309, and substrate 310.

Figure 3S:
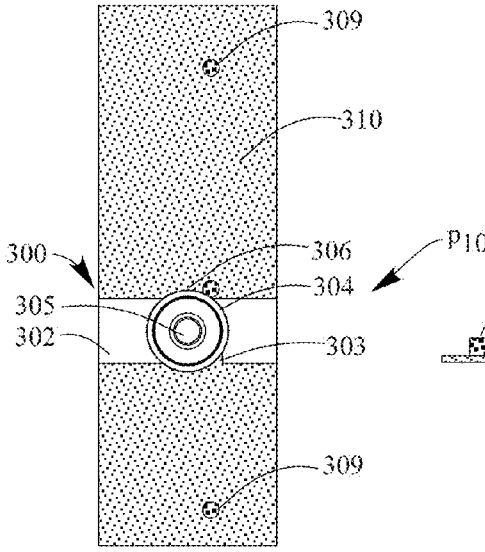
FIG. 3S is a top environmental view of the notched fluid applicator at position $p_{10}$.

FIG. 3S is a top environmental view of the notched fluid applicator 300 at position $p_{10}$. Shown are optional knurling 306, cap 304, notch 303, orifice 305, base 302, protrusion 309, and substrate 310. The notched fluid applicator 300 is moved vertically downward, completing the 'jump' over protrusion 309, until it contacts the substrate 310 at position $p_{10}$.

Figure 3T:
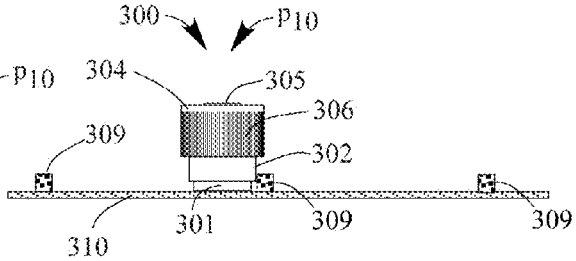
FIG. 3T is a right side environmental view of the notched fluid applicator at position $p_{10}$.

FIG. 3T is a right side environmental view of the notched fluid applicator 300 at position $p_{10}$. Shown are orifice 305, optional knurling 306, cap 304, dispenser pad 301, base 302, protrusion 309, and substrate 310.

Figure 3U:
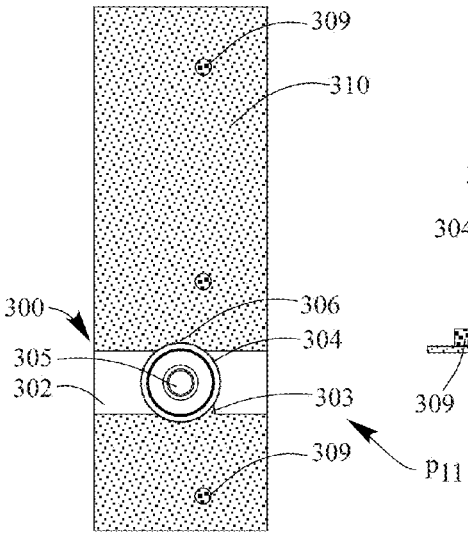
FIG. 3U is a top environmental view of the notched fluid applicator at position $p_{11}$.

FIG. 3U is a top environmental view of the notched fluid applicator 300 at position $p_{11}$. Shown are optional knurling 306, cap 304, notch 303, orifice 305, base 302, protrusion 309, and substrate 310. The notched fluid applicator 300 is moved horizontally along the substrate 310 through position $p_{11}$.

Figure 3V:
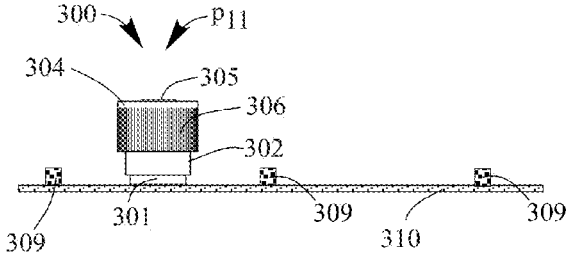
FIG. 3V is a right side environmental view of the notched fluid applicator at position $p_{11}$.

FIG. 3V is a right side environmental view of the notched fluid applicator 300 at position $p_{11}$. Shown are orifice 305, optional knurling 306, cap 304, dispenser pad 301, base 302, protrusion 309, and substrate 310.

Figure 3W:
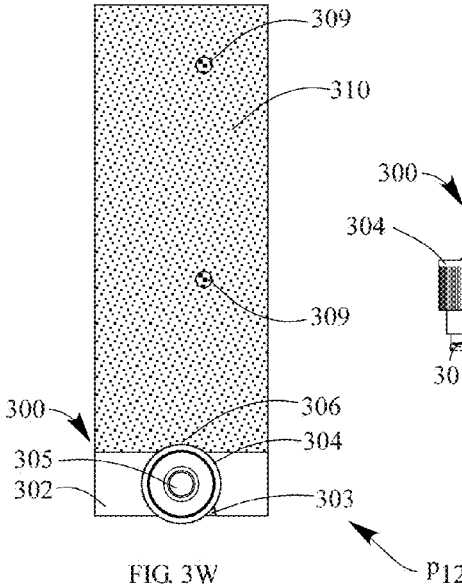
FIG. 3W is a top environmental view of the notched fluid applicator at position $p_{12}$.

FIG. 3W is a top environmental view of the notched fluid applicator 300 at position $p_{12}$. Shown are optional knurling 306, cap 304, notch 303, orifice 305, base 302, protrusion 309, and substrate 310. The notched fluid applicator 300 has moved horizontally to position $p_{12}$, so that the notch 303 surrounds the protrusion 309. The notch 303 allows the dispenser pad 301 to lay a uniform layer of fluid around the protrusion 309 without using a circular motion around the protrusion 309.

Figure 3X:
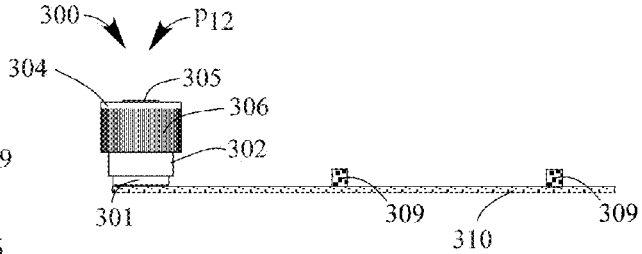
FIG. 3X is a right side environmental view of the notched fluid applicator at position $p_{12}$.

FIG. 3X is a right side environmental view of the notched fluid applicator 300 at position $p_{12}$. Shown are orifice 305, optional knurling 306, cap 304, dispenser pad 301, base 302, protrusion 309, and substrate 310.

Figure 3Y:
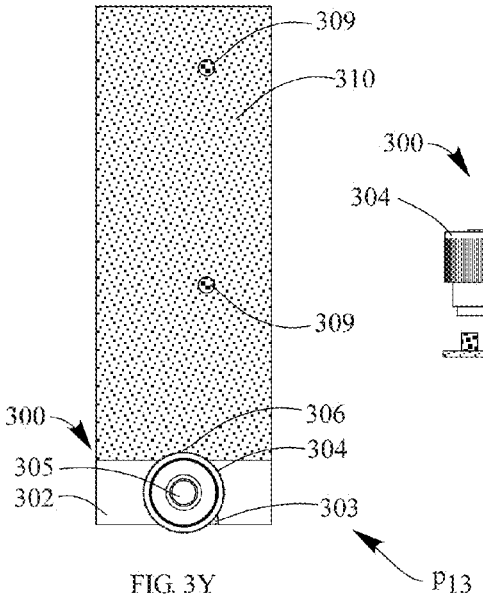
FIG. 3Y is a top environmental view of the notched fluid applicator at position $p_{13}$.

FIG. 3Y is a top environmental view of the notched fluid applicator 300 at position $p_{13}$. Shown are optional knurling 306, cap 304, notch 303, orifice 305, base 302, protrusion 309, and substrate 310. Notched fluid applicator 300 is moved vertically upward to position $p_{13}$, so as to 'jump' over the protrusion 309.

Figure 3Z:
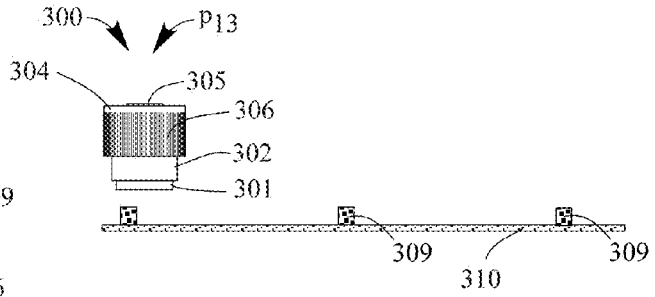
FIG. 3Z is a right side environmental view of the notched fluid applicator at position $p_{13}$.
Figure 3A:
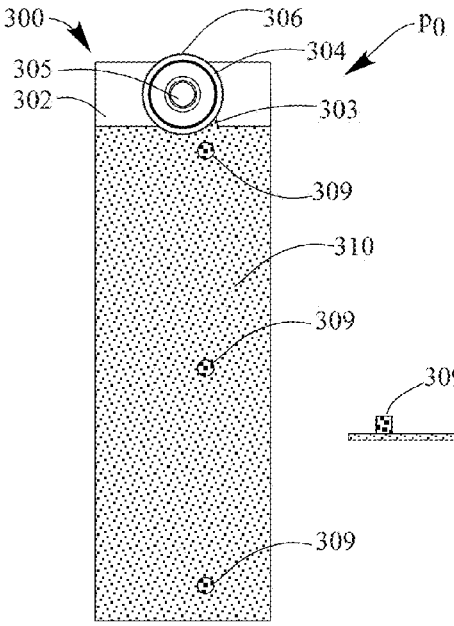
Figure 3B:
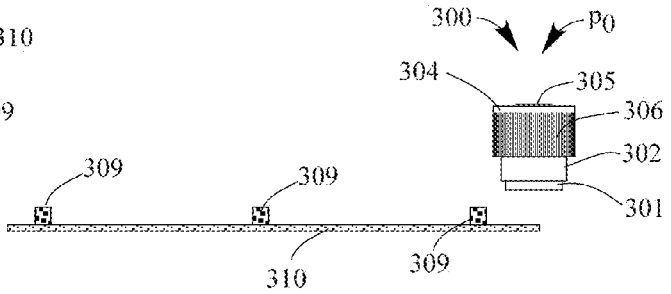
Figure 3C:
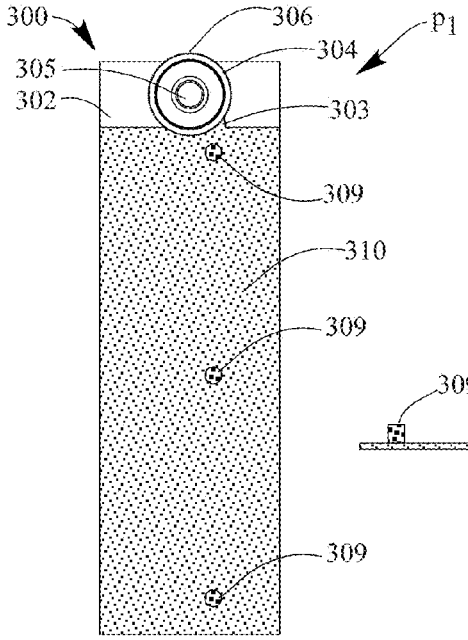
Figure 3D:
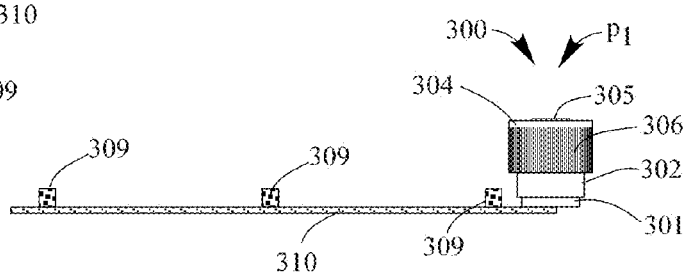

FIG. 3Z is a right side environmental view of the notched fluid applicator 300 at position $p_{13}$. Shown are orifice 305, optional knurling 306, cap 304, dispenser pad 301, base 302, protrusion 309, and substrate 310.

FIG. 3AA is a top environmental view of the notched fluid applicator 300 at position $p_0$. Shown are optional knurling 306, cap 304, notch 303, orifice 305, base 302, protrusion 309, and substrate 310. The notched fluid applicator 300 is moved horizontally to position $p_0$, to begin the process again.

FIG. 3BB is a right side environmental view of the notched fluid applicator 300 at position $p_0$. Shown are orifice 305, optional knurling 306, cap 304, dispenser pad 301, base 302, protrusion 309, and substrate 310.

FIG. 3CC is a top environmental view of the notched fluid applicator 300 at position $p_1$. Shown are optional knurling 306, cap 304, notch 303, orifice 305, base 302, protrusion 309, and substrate 310. The notched fluid applicator 300 is moved vertically downward, completing the 'jump' to the beginning of the process, until it contacts the substrate 310 at position $p_1$. The process may be repeated as many times as needed to complete the task.

FIG. 3DD is a right side environmental view of the notched fluid applicator 300 at position $p_1$. Shown are orifice 305, optional knurling 306, cap 304, dispenser pad 301, base 302, protrusion 309, and substrate 310.

In the practice of this invention, the notch allows the fluid applicator to move along the surface up to and beyond each surface protrusion without rotating the applicator such that the fluid is applied to the surface up to and past each side of the protrusion. The applicator is lifted by hand or with a robot over the protrusion and is set down on the other side of the protrusion to continue applying fluid onto the next protrusion (if any) or to the end of the substrate being primed.

In one embodiment, there are multiple applicators applying primer to the substrate. In another embodiment, there are applicators moving in different directions. In other embodiments, it is contemplated that the applicator may have more than one notch to allow applying fluid to two or more protrusions which are side by side.

In one specific embodiment and best mode, the notched fluid applicator is used to apply primer to the surface of plastic trim pieces approximately 21 inches wide with pins (not to be primed) protruding from each surface to be primed. However, the applicator may be used on trim pieces of different widths ranging from about ½ inch to about 6 inches. The applicator is used in combination with a robot, but could be used by hand to coat the flat surface with primer. The notch portion of the applicator goes around each pin and prevents the pins from being coated.

The robot (or person if by hand) commences coating the flat section of the substrate with the fluid applicator. As the notched fluid applicator moves over the pin where the notch is strategically positioned, the person or robot lifts the applicator tip over the pin to the opposite side of the pin and continues to coat the surface up to the next pin or finish coating the substrate. The substrate is coated and the pins are not. However, in some embodiments, the pins may be coated to some degree.

The applicator may contain multiple notches for different pin positions or to avoid other areas of the surface not requiring the application of the coating.

The fluid applicator comprises a base that may include optional structures such as shoulders and a cap as shown in the drawings. The base is typically made of a polymeric substance, for example a thermoplastic. In one embodiment and best mode, there is used a high-density polyethylene or high strength polypropylene including composites or blends thereof. The fluid applicator structure may be made of other polymer materials including polyvinyl chloride, polycarbonate, and polyamides. Composites or blends may be used, particularly composites or blends of high density polyethylene and high strength polypropylene. The structure of the fluid applicator may also be made of a wide range of other materials including rubber, ceramic or glass or sintered powdered metal. The base and any other structure such as a shoulder(s) and/or cap are generally made of the same material, but such can be of a different material.

The dispenser pad is a porous material made of an organic (natural) or synthetic material typically with a wicking or absorption property so that the porous material can readily absorb a fluid such as a liquid for transfer to the object. Wicking is the absorption of a liquid into the porous material by capillary action. However, in the practice of this invention, the liquid is flowed into the porous material by a pumping action or by gravity feeds. The absorbed liquid is dispensed from the porous material and deposited on the object. A pressure pot, squeeze bottle, metering pump, gravity head or like reservoir may be used as a source of the liquid to the applicator. A high viscosity liquid may require pressure for flow through the porous material. A low viscosity liquid such as an aqueous solution may flow freely through the porous material with little or no pressure.

The dispenser pad may be made from one or more porous materials such as a matrix of felted, woven, or non-woven fibers or filaments. The porous material may comprise a single layer of the selected material or multiple plies or layers depending upon the required fluid flow properties, fluid flow characteristics, fluid flow rates, and other factors that may affect the dispensing of the fluid.

Depending upon the application, any suitable porous material may be used for dispensing the fluid to the object. The criteria for selecting the porous material includes the compatibility of the porous material with the fluid to be dispensed particularly the chemical composition and flow properties. The properties and characteristics of the selected porous material including chemical composition, thickness, geometry, and porosity are determined by the chemical and physical properties and characteristics of the fluid to be flowed and dispensed, including any solids carried in the fluid.

The internal construction of the porous material may comprise single or multiple plies of a homogeneous or non-homogeneous composition including a composite and/or blend of several materials. The porous material is selected to provide the desired flow or percolation rate for the fluid and/or solids.

The flow or percolation rate may be determined for a liquid by the capillary action of the porous material and/or by the gravity or pressure flow of the liquid through the porous material. The properties that affect liquid flow through the porous material include pore size, liquid viscosity, liquid temperature, liquid chemical composition, reactivity of the liquid with the porous material, the liquid holding capacity of the porous material, and the geometric form or shape of the porous material. The porous material may be of any suitable geometric form or shape for absorption and dispensing the liquid to the object. In one embodiment, the porous material is in the shape of a resilient pad for contact with the surface. The pad contact area with the surface may be circular, elliptical, square, rectangular, triangular, and so forth. The pad is generally precut into a desired shape and then fitted inside the base.

The pore size of the porous material will vary depending upon the chemical and physical characteristics of the fluid to be dispensed. The term pore size is the size of the interstices of the material. The average or mean pore size can be determined by any standard test for determining porosity and pore size distribution. For example, X-ray porosimetry, mercury porosimetry, and wicking techniques are some of the methods used to determine porosity and pore size.

The porous material may comprise a wide range of densities and specific gravities. In one embodiment, the density of the selected porous wicking material ranges from about 0.003 to about 0.368 ounces per cubic inch. The thickness of the porous material ranges from about 35 mils to about 1.5 inches or more.

The composition of contemplated porous materials includes any suitable natural or synthetic substance. Examples of natural or organic substances with a suitable flow property include cotton, natural sponge, cloth, wool, plant fiber, bristles, hemp, animal fur, synthetic, and animal hair. Animal hair may be used including human, horse, camel, and goat hair. In one specific embodiment, there is used goat hair such as mohair, or a woven nylon material.

The porous materials also include synthetic substances such as synthetic sponge, glass fibers, metal fibers and polymeric substances. Examples of polymeric substances include polyamides and polyesters. The polyamides include nylon, nylon-6, and nylon-6,6. The polyesters include condensation polymers that contain an ester functional group in the primary or main chain such as polycarbonate and polyethylene terephthalate (PET). In one embodiment, there is used a felt or foam made from polyester such as PET. In other embodiments, there is used a composite of polyester and polyamide such as PET and nylon.

In one embodiment, a brush is used instead of a porous material. The brush may also be used in combination with porous material. The brush is held by the base and serves to apply a fluid such as a liquid to an object. The brush may be made of an organic or natural material such as animal hair including human hair, horse hair, camel hair or goat hair. The brush may be made of other organic or natural materials similar to those used for the porous material including soft or stiff cotton, sponge, cloth, wool, plant fibers, bristles, and hemp. Animal fur and feathers are also contemplated. The brush may also be made of synthetic materials such as synthetic sponge, glass fibers, metal fibers and polymeric substances including the polyamides and polyesters. The polyamides include nylon, nylon-6, and nylon-6,6. The polyesters include condensation polymers that contain an ester functional group in the primary or main chain such as polycarbonate and polyethylene terephthalate (PET).

In accordance with another embodiment, at least one fluid passage through-hole is formed in the porous material or brush so as to enhance the flow of the fluid through the material or brush to the object. Depending upon the thickness of the porous material and the viscosity of the particular fluid to be flowed, the fluid flow may be enhanced especially through thick porous material by mechanically forming a fluid passage through-hole through the porous material.

The diameter of the through-hole ranges from about 10 to about 150 mils, typically about 15 to about 75 mils. A mil is defined as 0.001 inch. The depth or thickness of the through-hole ranges from about 35 mils to about 1.5 inches. Depending on the chemical composition of the porous material or brush, the through-hole may be formed by any suitable means. Multiple through-holes may be formed in the porous material or brush.

A wide variety of fluids may be dispensed by the notched fluid applicator for preparing or treating a surface or surfaces with protrusions. Such preparation or treatment comprise coating, cleaning, etching, and surface enhancing including the application of adhesives, glues, fillers, pigments, or the like. Multiple surfaces may be simultaneously treated.

Fluid as used herein includes liquids or gases. Examples of liquids include silane, amino silane, urethane, isocyanates, diisocyanate, polyisocyanate, xylene, p-xylene, ketones such as methyl isobutyl ketone (MIBK) and methyl ethyl ketone (MEK), acids such as acetic acid (vinegar), boric acid, nitric acid (for etching) and vehicles and/or solvents such as ethers, acetone, glycols, alcohols including methyl alcohol and isopropyl alcohol, and benzenes including alkyl benzenes such as ethyl benzene. A number of other liquids including vehicles and solvents may be used in addition to those listed herein. The selected liquid(s) may comprise a mixture of those listed above and/or other liquids not listed.

The liquid may contain selected solid particulates such as carbon black, which is suitable for ultraviolet (UV) screening and protection of the window seal in automobiles. The selected solid particulates may also comprise inorganic and organic pigments, fillers, dyes, and phosphors for selected applications such as quality control and detection including quantitative and quality analyses.

Examples of inorganic solids or particulates include inorganic compounds of metals and/or metalloids including mixtures or combinations thereof. The inorganic compounds include, not by way of limitation, oxides, carbides, nitrides, nitrates, silicates, aluminates, sulfides, sulfates, phosphates, borosilicates, borides, and/or borates.

The metals and/or metalloids include, not by way of limitation, one or more selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Specific compounds include titanium oxide(s), zinc oxide(s), magnesium oxide(s), aluminum oxide(s), zirconium oxide(s), silicon oxide(s), and silicon carbide(s) such as $TiO_2$, ZnO, MgO, $Al_2O_3$, $ZrO_2$, $SiO_2$, and/or SiC.

Other particulate solids include particles of glass, ceramic, glass ceramic, refractory, fused silica, quartz, or like amorphous and/or crystalline materials including mixtures of such. There may also be used particles of plastics, rubber, metals, and inorganic or organic luminescent materials such as phosphors.

Examples of organic particulates include polymeric substances such as acrylic, polyurethane, or epoxy synthetic resins dissolved in a suitable solvent. Such organic particulates may comprise one or more organic compounds, monomers, dimers, trimers, polymers, copolymers, or like organic or polymeric materials including organic dyes, dopants, and organic luminescent materials such as phosphors. The particulates are incorporated into the fluid by any suitable means such as a ball mill, fluid bed or a spray nozzle so as to provide a solution, dispersion, or suspension of the particulates in the fluid.

In one embodiment hereof, the fluid is a gas such as air, steam, nitrogen, oxygen, carbon dioxide, rare gas or the like with finely divided solids or particulates suspended in the gas stream. The rare gas is selected from neon, argon, xenon, krypton, and helium including mixture thereof. The solids or particulates are as defined above.

The fluid applicator or fluid applicator tip as illustrated in the drawings may have other geometric shapes, designs, and/or configurations. In the many contemplated uses, the fluid applicator has a shape, design, and/or configuration that contacts and/or interacts with one or more surfaces of the object, such as a top and bottom surface, a top and side surface, a bottom and side surface, or all three surfaces. Examples of other shapes, designs, and/or configurations of fluid applicator tips are disclosed in the U.S. patents listed above as related prior art and incorporated herein by reference. These include U.S. Pat. No. 5,131,349 (Keller et al.), U.S. Pat. No. 5,743,959 (Ash et al.), U.S. Pat. No. 6,547,880 (Krueger et al.), U.S. Design 480,959 (DeWood), U.S. Design 480,632 (Williams et al.), and U.S. Design 468,633 (DeWood). The dimensions of the fluid applicator base and dispensing pad or brush are determined by the area of contact with the surface.

The fluid applicator may be positioned on an appropriate fluid dispenser and fluid source such as a squeeze bottle or hand dispenser. The fluid applicator may also be positioned on a compliance mechanism as disclosed in U.S. Pat. No. 6,649,220 issued to Wallace F. Krueger, et al. listed above as related prior art and incorporated by reference. It may also be positioned on a mechanism controlled by a robot and an automated primary station as disclosed in U.S. Pat. No. 6,641,665 (Krueger) and U.S. Pat. No. 6,471,774 (Krueger) cited above and incorporated by reference. It may also be positioned on the other systems listed above as related prior art.

Other Applications

Although the notched fluid applicator is generally described herein with regard to the automotive industry, this invention is also suitable for a wide range of other fluid applications. The automotive application is only one use and is not intended to limit the scope of the applications for this invention.

A wide range of other applications are contemplated where a fluid and/or solid are to be deposited on a surface.

For example, the notched fluid applicators of this invention may be used to apply glue to a surface with protrusions or to etch a surface with acid such as nitric acid or solvent such as acetone. Such alternative applications include etching or decorating of a substrate with protrusions for use in architecture.

Another use in the electronic industry is the application of conformal coatings to printed circuit boards and other surfaces. Other uses include optical fiber coatings, solar cell substrates, and any other applications that require uniform coatings or films of primers, conformal coatings, lubricants, paints, varnishes, enamels, glues, pastes, frits, etc. on a surface.

Conformal Coatings

It is contemplated that this invention may be used for coating substrates with protrusions in the electronics industry. Conformal coatings are widely used in the electronics industry to coat printed circuit boards to protect electronic components, conductors, and electrical connections from moisture, dust, and electronic leakage. The notched fluid applicators of this invention may be used to dispense and deposit conformal coatings on circuit boards and other electronic substrates that have protrusions. Examples of conformal coating compositions and applications are disclosed in the prior such as U.S. Pat. No. 5,510,138 (Sanftleben et al.); U.S. Pat. No. 5,188,864 (Lee et al.); U.S. Pat. No. 4,880,663 (Shimada); U.S. Pat. No. 4,824,875 (Gutek); U.S. Pat. No. 4,753,819 (Shimada); and U.S. Pat. No. 4,600,601 (Tamura), all incorporated herein by reference.

Electronic Circuits

The applicator tips of this invention may be used to form electric circuits by depositing layers of conductive, resistive, and/or dielectric materials such as pastes on substrates with protrusions.

Solar Substrates

The notched fluid applicators may also be used to apply fluids including fluids carrying particulate solids to glass or other substrates used in solar panels, for example as disclosed in U.S. Pat. No. 5,945,163 (Powell et al.) and U.S. Pat. No. 6,058,740 (McMaster et al.).

SUMMARY

The foregoing description of various embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In a fluid applicator for applying a fluid to a surface, said applicator comprising a base and a dispenser pad affixed to the base, the improvement wherein the base is notched so as to allow the applicator to move up to and beyond a surface protrusion without rotating the applicator such that a fluid is applied to the surface up to and past each side of the protrusion.

2. The fluid applicator of claim 1 wherein the base is a plastic selected from high-density polyethylene or a high strength polypropylene including composites and blends thereof.

3. The fluid applicator of claim 1 wherein the dispenser pad is a porous material selected from a natural or synthetic substance.

4. The fluid applicator of claim 3 wherein the natural substance is one or more members selected from cotton, natural sponge, cloth, wool, plant fiber, bristles, hemp, and/or hair.

5. The fluid applicator of claim 4 wherein the hair is one or more members selected from human hair, horse hair, goat hair, and/or camel hair.

6. The fluid applicator of claim 5 wherein the hair is mohair.

7. The fluid applicator of claim 3 wherein the synthetic substance is one or more members selected from synthetic sponge, glass fibers, and/or polymeric substances.

8. The fluid applicator of claim 7 wherein the polymeric substance is a polyamide or polyester.

9. The fluid applicator of claim 8 wherein the polyamide is nylon, nylon-6, or nylon-6, 6.

10. The fluid applicator of claim 8 wherein the polyester is a condensation polymer containing an ester functional group in the primary chain.

11. The fluid applicator of claim 10 wherein the polyester is polycarbonate or polyethylene terephthalate.

12. A fluid applicator for applying a fluid to a surface, said applicator comprising a plastic base and a dispenser pad affixed to a plastic base, said plastic base having at least one notched portion so as to allow the applicator to move up to and beyond a surface protrusion without rotating the applicator such that a fluid is applied to the surface up to and past each side of the protrusion.

13. The fluid applicator of claim 12 wherein the plastic base is a plastic selected from high density polyethylene or high strength polypropylene including composites and blends thereof.

14. The fluid applicator of claim 12 wherein the porous material is selected from a natural substance or synthetic substance.

15. In a process for manufacturing a fluid applicator tip for applying a fluid to a surface, said applicator comprising a base and a dispenser pad or brush affixed to the base, the improvement wherein a notch is formed in the base so as to allow the applicator to move up to and beyond a surface protrusion without rotating the applicator such that a fluid is applied to the surface up to and past each side of the protrusion.

* * * * *